US006848229B2

(12) United States Patent
Rossi

(10) Patent No.: US 6,848,229 B2
(45) Date of Patent: Feb. 1, 2005

(54) TILE LAYING TOOL AND METHOD OF USING SAME

(76) Inventor: Steve Rossi, 611 Sweet Fern La., Sugarhill, GA (US) 30518

( * ) Notice: Subject to any disclaimer, the term of this patent is extended or adjusted under 35 U.S.C. 154(b) by 0 days.

(21) Appl. No.: 10/124,301

(22) Filed: Apr. 17, 2002

(65) Prior Publication Data

US 2003/0196407 A1 Oct. 23, 2003

(51) Int. Cl.[7] ..... E04B 21/00

(52) U.S. Cl. ..... 52/367; 52/302.1; 4/613; 249/160; 249/188

(58) Field of Search ..... 249/160, 188, 249/155, 144; 52/749.1, 749.13, 302.1, DIG. 1, 364, 365, 370, 371, 302.3, 742.14, 318, 169.7; 4/613; 404/2; 425/458, 218, DIG. 1, DIG. 57

(56) References Cited

U.S. PATENT DOCUMENTS

| | | | | | |
|---|---|---|---|---|---|
| 572,509 | A | * | 12/1896 | Wilson | 249/144 |
| 812,336 | A | * | 2/1906 | Glatfelter | 249/155 |
| 1,001,622 | A | * | 8/1911 | Crane | 264/679 |
| 1,017,167 | A | | 2/1912 | Pleins | |
| 1,539,148 | A | * | 5/1925 | Pascal | 264/162 |
| 1,720,503 | A | * | 7/1929 | Wickey | 249/99 |
| 1,770,518 | A | * | 9/1930 | Harrold | 249/5 |
| 2,039,374 | A | * | 5/1936 | Young | 99/426 |
| 2,529,354 | A | * | 11/1950 | Schroeder | 220/506 |
| 2,672,205 | A | * | 3/1954 | McDonald | 285/42 |
| 3,128,725 | A | * | 4/1964 | Becker | 249/155 |
| 3,231,902 | A | * | 2/1966 | Racina | 52/169.7 |
| 3,562,993 | A | * | 2/1971 | Humble et al. | 52/663 |
| 3,902,837 | A | * | 9/1975 | Glasgow | 425/458 |
| 4,261,541 | A | * | 4/1981 | Morrow | 249/10 |
| 4,395,015 | A | * | 7/1983 | Reardon | 249/115 |
| 4,406,439 | A | * | 9/1983 | Garter | 249/64 |
| 4,462,123 | A | * | 7/1984 | Morris et al. | 4/286 |
| 4,541,132 | A | * | 9/1985 | Long | 4/614 |
| 5,140,789 | A | * | 8/1992 | De Gooyer | 52/71 |
| 5,371,980 | A | * | 12/1994 | Dix | 52/34 |
| 5,413,472 | A | * | 5/1995 | Dietterich et al. | 425/183 |
| 5,476,135 | A | * | 12/1995 | Volkmann | 164/374 |
| 5,538,217 | A | * | 7/1996 | Chauhan | 249/57 |
| 5,932,255 | A | * | 8/1999 | Ditcher et al. | 425/121 |
| 6,003,169 | A | | 12/1999 | Davis, Jr. | |
| 6,088,984 | A | | 7/2000 | Kirby | |
| 6,155,015 | A | * | 12/2000 | Kirby | 52/302.1 |
| 6,329,007 | B1 | * | 12/2001 | Khusro | 426/502 |
| 6,568,140 | B2 | * | 5/2003 | Kirby | 52/302.1 |
| 2003/0037497 | A1 | * | 2/2003 | Kirby | 52/302.1 |
| 2003/0052425 | A1 | * | 3/2003 | Griffith | 264/1.32 |

FOREIGN PATENT DOCUMENTS

| | | | |
|---|---|---|---|
| DK | 71294 | * | 7/1950 |
| FR | 2439655 | * | 6/1980 |
| GB | 646335 | * | 11/1950 |
| GB | 715432 | * | 9/1954 |
| GB | 836579 | * | 6/1960 |
| GB | 1439748 | * | 6/1976 |

* cited by examiner

*Primary Examiner*—Robert Canfield
(74) *Attorney, Agent, or Firm*—Needle & Rosenberg, P.C.

(57) ABSTRACT

Apparatuses and methods for shaping a graded surface of a fill material around a drain are disclosed. The apparatus provides an outer ring for positioning within a shower enclosure, an inner ring for positioning within the outer ring and around the drain, a rail assembly connected at each of two ends to the outer ring, and a carriage connected to the rail assembly and the inner ring. Each of the inner ring and outer ring provides a top edge to which the surface of the fill material can be brought flush.

12 Claims, 4 Drawing Sheets

TILE LAYING TOOL AND METHOD OF USING SAME

BACKGROUND OF THE INVENTION

1. Field of the Invention

The invention relates, generally, to tools and methods for constructing a graded surface. More particularly, the invention relates to tools and methods for preparing a well-graded fill material surface around a drain prior to the laying of tile in the construction of a sloped floor, for example the floor of a shower enclosure.

Proper construction of a floor surface upon which incident water is to be collected in a drain location is a common challenge in building construction. Such a floor surface should be smoothly graded across its extent with sufficient and consistent inclination to provide water collection at the intended location, such as a drain, while unwanted pooling of water in other areas should be prevented. Further, for the comfort and safety of a person standing on the floor surface, unduly sharp or non-uniform inclinations are to be avoided. Current typical construction involves ad-hoc solutions and arrangements by a skilled craftsperson and consistent results are therefore unlikely or expensive.

2. Background Art

Pre-formed shower floor units have long been available for simple placement in a shower enclosure. These can be pre-fabricated and installed within an enclosure of specific dimensions and therefore suffer the disadvantage that they are not adaptable at the time of installation. The shower enclosure must match the available pre-formed unit or, alternatively, the shower enclosure can be measured and a custom fit unit can be fabricated to order, requiring a substantial delay in the construction project.

Each of U.S. Pat. Nos. 6,088,984 and 6,155,015 disclose a system of rail members arranged radially about a drain for use in forming a shower floor. The rail members provide top edges to which the top surface a fill material can be brought flush to establish a graded surface. The inventions of these patents suffer the disadvantage that each rail member must be cut to a tailored length spanning the distance between a flange centered around the drain and the wall of a shower enclosure thereby consuming time and requiring an on-hand supply of specialized rail-member material. Further, the disclosed rail members effectively divide the floor area into several graded sections such that a resulting uniformly graded surface about the drain does not appear to be possible.

There is a need for an apparatus and method for producing a well-graded sub-tile fill material in the construction of a shower or drain area. A preferable apparatus and method for such should provide easily reproducible results and provide for the construction of a floor that adjoins enclosing walls at a consistent height.

SUMMARY OF THE INVENTION

One embodiment of the invention relates to an apparatus for shaping a graded surface of a fill material around a drain. The apparatus comprises an outer ring for positioning within a shower enclosure, an inner ring for positioning within the outer ring and around the drain, a rail assembly connected at each of two ends to the outer ring, and a carriage connected to the rail assembly and the inner ring. Once positioned, each of the inner ring and outer ring provides a top edge to which the surface of the fill material can be brought flush. The inner ring is be pivotally connected to the carriage, which is movably connected to the rail assembly. The rail assembly is connected to and located above the outer ring. The carriage and rail assembly together define a position range of the inner ring within a boundary defined by the outer ring.

One aspect of the invention relates to a method of shaping a graded surface of a fill material around a drain using a blade, an inner ring, and an outer ring. The method comprises placing the outer ring within a shower enclosure, positioning the inner ring around the drain within the boundary defined by the outer ring and preferably centered around the drain, introducing a fill material into at least an area defined between the inner ring and outer ring, placing the blade substantially radially to the drain and contacting the top edge of the inner ring and the top edge of the outer ring, and working the fill material with the blade so that a graded surface of the fill material is defined by the lower edge of the blade as the blade is moved around the circumferences of the two rings while maintaining a radial orientation relative to the drain.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DETAILED DESCRIPTION OF THE PREFERRED EMBODIMENTS

The present invention may be understood more readily by reference to the following detailed description of preferred embodiments of the invention and to the Figures.

Before the present devices and methods are disclosed and described, it is to be understood that the terminology used herein is for the purpose of describing particular embodiments only and is not intended to be limiting. It must be noted that, as used in the specification and the appended claims, the singular forms "a", "an" and "the" include plural referents unless the context clearly dictates otherwise.

Figure 1:
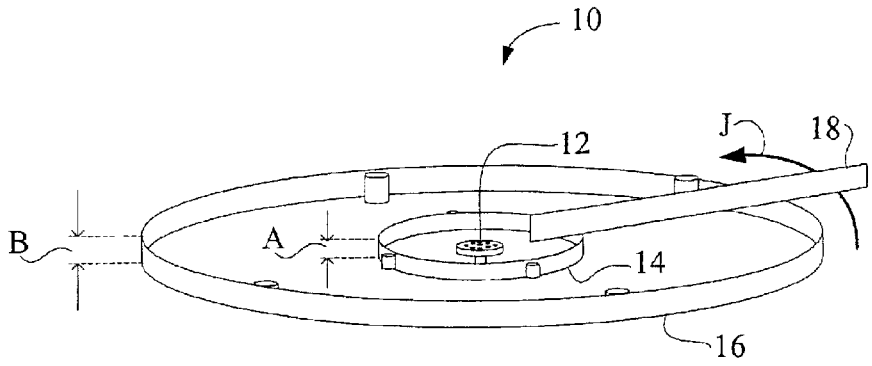
FIG. 1 is a perspective view of an embodiment of an apparatus for shaping a graded surface around a drain.

Referring now to FIG. 1 the present invention provides in one embodiment an apparatus 10 for shaping a graded surface of a fill material around a drain 12. The apparatus 10 comprises an inner ring 14 having an inner-ring height A, and an outer ring 16 having an outer-ring height B greater than the inner-ring height A, and an elongate surfacing blade 18 placed substantially radially to the drain in contact with the top edge of the inner ring 14 and the top edge of the outer ring 16 and extending at least therebetween. The outer ring 16 is placed around the drain 12 and the inner ring 14 is positioned around the drain 12 within a boundary defined by the outer ring 16 as illustrated. The outer ring 16 is greater in extent than the inner ring 14 in that an area enclosed by the outer ring 16 is greater than an area enclosed by the inner ring 14.

Figure 2:
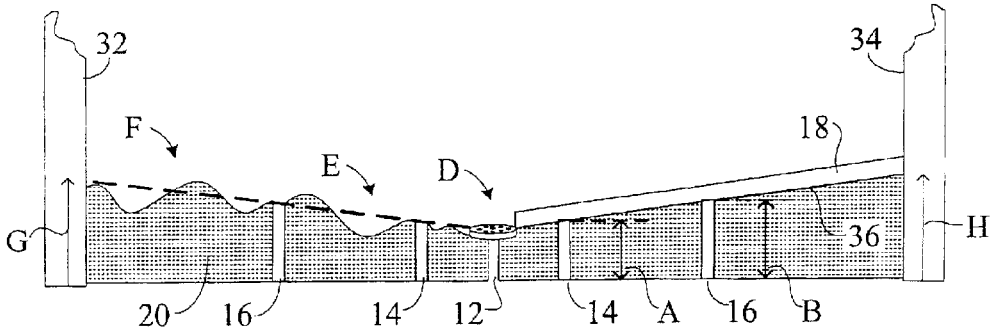
FIG. 2 is a cross-sectional view of the apparatus of FIG. 1 placed within a shower enclosure defined by upright walls.

In FIG. 2, the inner ring 14 and outer ring 16 are illustrated in cross-sectional view for clarity. A fill material 20 such as a cement, grout, mud, or mixture may be introduced into an enclosed area D defined within the inner ring 14, an enclosed area E defined between the outer ring 16 and the inner ring 14, and an enclosed area F defined beyond the outer ring and within an architectural space, for example, a shower enclosure defined between a first upright wall 32 and a second upright wall 34. A graded upper surface 36 of the fill material 20 is defined below the lower edge of the blade 18. A sweeping movement J (FIG. 1) of the blade 18 works the fill material 20 so the upper surface 36 can be defined upon the entirety of the fill material 20 with a first height G at the first upright wall 32 and a second height H at the second upright wall 34. A substantially conical graded surface 36 may thus be prepared upon which tile (not shown) may be laid following any appropriate period for hardening, curing, drying, or setting of the fill material 20.

The degree and uniformity of the inclination of the graded upper surface 36 are defined by the difference of the inner-ring height A and the outer-ring height B and by the relative positions of the inner and outer rings. As illustrated in FIG. 2, positioning of the inner ring 14 and outer ring 16 to be each concentric about the drain 12 which is centered between the first upright wall 32 and the second upright wall 34 facilitates an upper surface 36 of the fill material 20 with equivalent first height G and second height H at the opposing first upright wall 32 and second upright wall 34, respectively. Such an arrangement is applicable to the construction of a shower with a geometrically centered drain. The equivalence of first height G and second height H may be preferred in the construction of a shower for aesthetics and the comfort of a person standing upon a finished tile floor comprising tile laid upon the graded upper surface 36 of the fill material 20.

Figure 3:
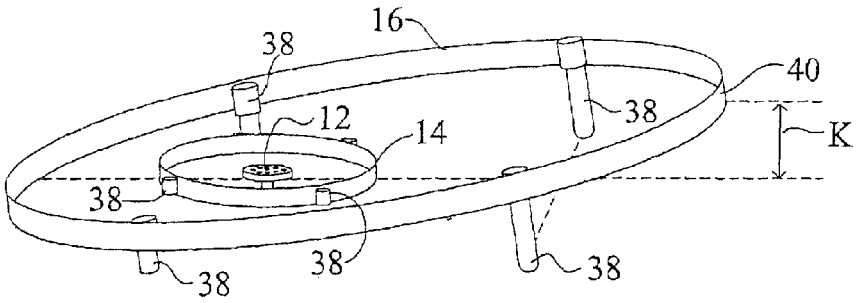
FIG. 3 is a perspective view of the apparatus of FIG. 1 with adjustable legs deployed.

An embodiment of the invention illustrated in perspective view in FIG. 3 comprises an inner ring 14 and an outer ring 16, each with adjustable legs 38 attached. The outer ring 16 is placed such that the position of the drain 12 is not at the center of the outer ring. The legs 38 of the outer ring are illustrated as deployed such that the inner ring 14 and outer ring 16 are not coplanar and the outer ring 16 is lifted an adjusted height K at the edge 40 located distal the drain position.

Figure 4:
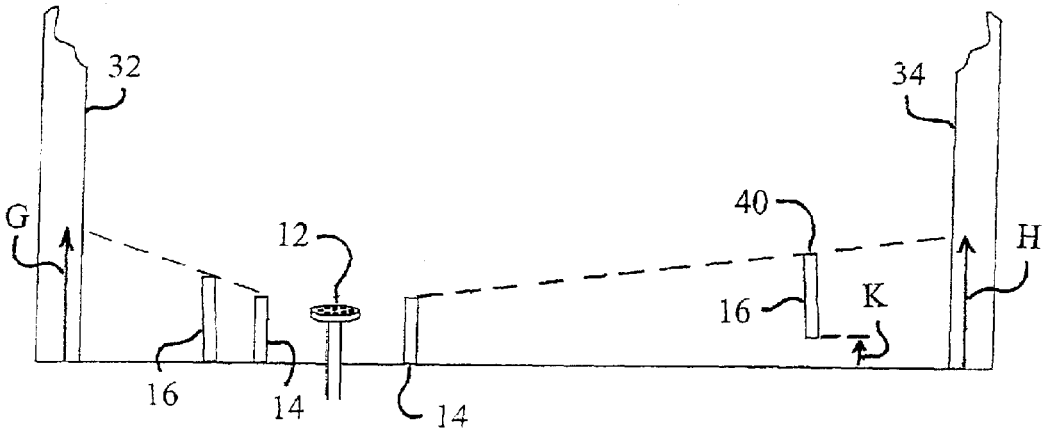
FIG. 4 is a cross-sectional view of the apparatus of FIG. 3 placed between upright walls.

FIG. 4 shows the embodiment of FIG. 3 with the inner ring 14 and outer ring 16 illustrated in cross-sectional view and the adjustable legs omitted for clarity. The inner ring 14 is positioned around the drain 12 that is in an off-center position within the architectural space defined between a first upright wall 32 and a second upright wall 34. The outer ring 16 is placed substantially centered between the upright walls and is lifted an adjusted height K at an edge 40 located distal the drain position such that the inner ring 14 and the outer ring 16 are not coplanar.

It is a common and difficult challenge to those skilled in the construction of shower floors and graded surfaces to prepare a graded upper surface of a fill material about a drain or vertical minimum that is not at the geometric center of an architectural boundary. For example, a shower may be needed within a space that is irregularly shaped, or the location of floor support joists and pipes may require an off-center drain position such as that of the drain 12 of FIG. 4. In such a construction it may nevertheless be preferred that a graded fill material surface be prepared which adjoins opposite walls at substantially equivalent heights In FIG. 4, the inner ring 14 and outer ring 16 are arranged so that when a fill material (not illustrated) is introduced and prepared as detailed above with reference to FIG. 2, an upper surface of the fill material will adjoin the first upright wall 32 at a first height G and will adjoin the second upright wall 34 at a second height H substantially equivalent to the first height G.

Figure 5:
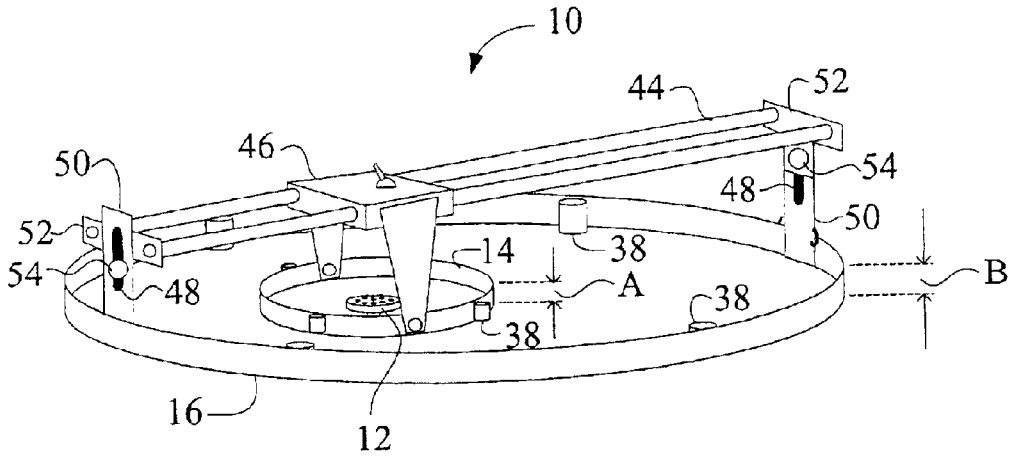
FIG. 5 is a perspective view of the preferred embodiment of the invention.

Referring now to FIG. 5, a preferred embodiment of the present invention illustrated in a perspective view provides an apparatus 10 for shaping a graded surface of a fill material around a drain 12. The apparatus 10 comprises an inner ring 14 having an inner-ring height A, and an outer ring 16 having an outer-ring height B greater than the inner-ring height A, a rail assembly 44 connected at each of two ends to diametrically opposed portions of the outer ring 16, and a carriage 46 movably connected to the rail assembly 44 and pivotally connected to diametrically opposed portions of the inner ring 14. The rail assembly 44, as illustrated in FIG. 5, can comprise, for example, a pair of cylindrical bars. Alternately, the rail assembly 44 can comprise any number of bars or any means for supporting the carriage 46 above the outer ring 16 and for allowing movement of the carriage 46 within a boundary defined above the outer ring 16 so that the inner ring can be positioned around the drain 12. Adjustable legs 38, illustrated as not deployed, are attached to each of the inner ring 14 and outer ring 16.

A specific implementation of the embodiment of the invention of FIG. 5 comprises a circular inner ring 14 with a diameter of approximately eleven inches (11.0 inch) and an inner-ring height A of approximately three-quarters of an inch (A=0.75 inch), a circular outer ring 16 with a diameter of approximately thirty three inches (33.0 inch) and an outer-ring height B of approximately one inch (B=1.00 inch). Such approximate dimensions may be preferred for use in the construction of shower floors within typical homes and apartments. However, other embodiments, within the scope of the invention, may be constructed with other shapes of other total and relative dimensions desirable in the construction of, for example, large-area sloped floors.

Figure 6:
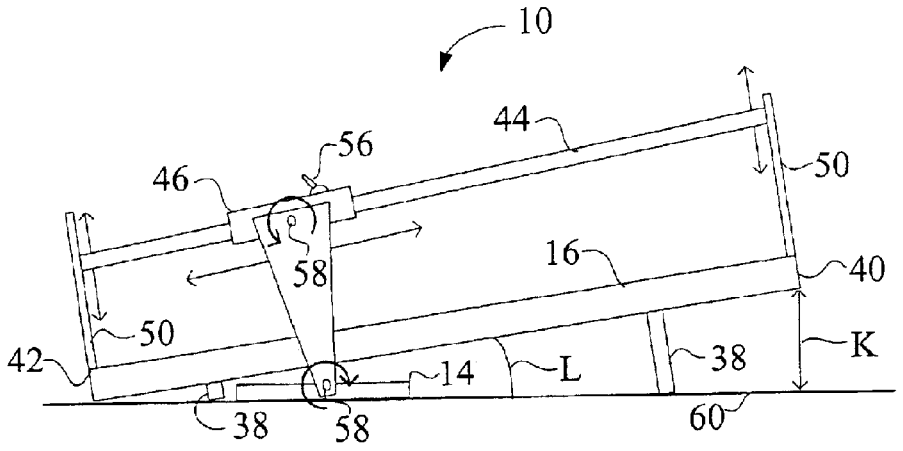
FIG. 6 is an elevational view of the preferred embodiment of the invention with adjustable legs deployed.

FIG. 6 provides an elevational view of the invention of FIG. 5 with the adjustable legs 38 of the outer ring 16 deployed. At each end, the rail assembly 44 is vertically adjustable with respect to the outer ring 16 to provide that the rail assembly can be sloped relative to the enclosed area of the outer ring. The slope and vertical adjustment of the rail assembly 44 relative to the outer ring 16 provides that movement of the carriage 46 can extend the inner ring 14 below the plane of the outer ring 16 as illustrated.

A means for adjustment provides that the vertical rail assembly is vertically adjustable with respect to the outer ring. A means for adjustment can comprise, as illustrated in FIG. 5, a slot 48 within an upstanding member 50 connected to the outer ring 16, and a rail end bracket 52 with a fastener 54 passed through and adjustably movable within the slot 48. The fastener 54 can be selected from known and conventional fasteners such as bolts, screws, and nut and bolt pairs.

The carriage 46, as illustrated in FIG. 6, is movably connected to the rail assembly 44, and comprises any means to movably and pivotally suspend the inner ring 14 below the rail assembly 44. The carriage 46 comprises a carriage-locking means 56 for fixing the position of the carriage 46 along the rail assembly 44 once a desirable position is reached. The carriage-locking means 56 can comprise, for example, a lever and cam lock, a thumbscrew or other locking set screw, a locking collar bushing, or any means known and conventional to fix a moving part upon a rail or rail assembly. The illustrated embodiment of the carriage 46 provides pivot joints 58 that each singly or together allow pivoting of the inner ring 14 relative to the outer ring 16 so that the inner ring can remain coplanar with a floor base 60 about the drain 12 (not visible) while the edge 40 of the outer ring 16 is lifted the adjusted height K, thereby defining an angle L between the plane of the inner ring and the plane of the outer ring. The adjustable legs 38 of the outer ring 16 are deployed and adjusted to reach the floor base 60 and fix the angle L.

The arrangement of the preferred embodiment illustrated in FIG. 6 may provide the benefit of the arrangement of the embodiment illustrated in FIG. 2; namely, that an upper surface of a fill material, prepared as detailed above with reference to FIG. 2, will join the first upright wall 32 at a first height G and will join the second upright wall 34 at a second height H equivalent to the first height G, all as illustrated in FIG. 2.

The arrangement of FIG. 6 can be effected by placing the outer ring 16 centrally within an architectural boundary (not illustrated) and around a drain (not visible), moving the carriage 46 to position the inner ring 14 along and below the sloped rail assembly 44 and around the drain, engaging the carriage locking means 56 to fix the position of the inner ring 14 relative to the rail assembly 44, lifting the edge 40 of the outer ring 16 to the adjusted height K thereby defining the angle L, and adjusting the legs 38 to reach the floor base 60 and fix the angle L. Lifting of the edge 40 of the outer ring 16 can be effected by a downward force on the edge 42 opposite the edge 40 such that the whole of the apparatus 10 less the inner ring 14 pivots about one or both of the pivot joints 58.

Preparation of a graded upper surface of a fill material about the drain can then proceed as detailed above with reference to FIG. 2. Upon completion of such preparation, the apparatus 10 (FIG. 6) can be removed from the fill material for subsequent reuse. Preparation of any number of similar fill material surfaces, such as in the construction of many essentially identical shower enclosures in an apartment building, can be conveniently served by placing the apparatus 10 without change of the arrangement and adjustments of FIG. 6.

As illustrated in FIG. 5, adjustable legs 38 can be provided with each of the inner ring 14 and outer ring 16. Particularly, the legs of the outer ring 16 provide for fixing the angle L (FIG. 6). Generally, the legs of the inner ring 14 and outer ring 16 can be deployed together to construct a graded upper surface above the floor base 60 (FIG. 6) at a variable height. Further, the legs of each of the inner ring 14 and outer ring 16 can be deployed and adjusted as necessary to accommodate a floor base 60 that is uneven or sloped (not illustrated).

Figure 7:
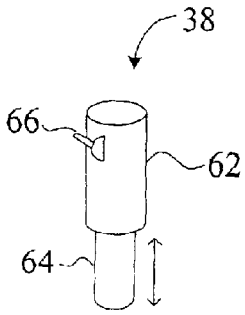
FIG. 7 is a perspective view of an embodiment of an adjustable leg.

An exemplary adjustable leg 38 is shown in FIG. 7. The illustrated embodiment provides a cylindrical housing 62 and an elongate post 64. The post 64 can be variably positioned within or extended from the housing 62. The post 64 can comprise a single stage or a plurality (not shown) of telescoping stages. The position of the post 64 relative to the housing 62 can be fixed by a leg locking means 66 which can comprise, for example, a lever and cam lock, a thumbscrew or other locking set screw, or any means known and conventional. The post 64 can be externally threaded and the housing 62 correspondingly internally threaded to provide for the adjustable reception of the post 64 within the housing 62. Each housing 62 can be integral with or connected to one of the inner ring 14 and outer ring 16 by weld or conventional fastener attachment.

Figure 8:
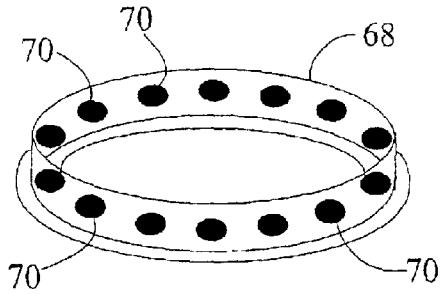
FIG. 8 is a perspective view of an embodiment of a ring.
Figure 9:
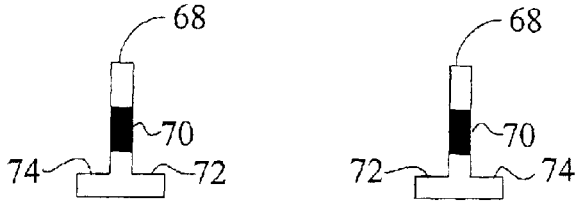
FIG. 9 is an elevational cross-sectional view of the ring of FIG. 8.

In one embodiment, shown in perspective view in FIG. 8 and in cross-sectional view in FIG. 9, each ring 68 of the inner ring 14 and outer ring 16 (FIG. 1) can comprise a plurality of apertures 70 formed within and extended through the ring. The apertures can provide for convenient flow of the fill material 20 during introduction and shaping as described above with reference to FIG. 2. The embodiment of the ring 68 illustrated in FIG. 8 and FIG. 9 also comprises an internal extended lip 72, extending to the interior or the ring, and an external extended lip 74, extending to the exterior of the ring, along the bottom edge of the ring 68 to provide for the strength of the ring 68.

Although the rings are illustrated in the figures as being substantially circular and smoothly arcuate, the inner ring 14 and outer ring 16 (FIG. 1) may each define any arcuate or polygonal open or closed curve. The inner and outer ring may each define, for example, a polygonal shape (not illustrated) to match typical shower enclosures such as a rectangle and may each be of fixed or variable dimensions to fixedly or variably match one or a variety of shower enclosure dimensions.

Figure 10:
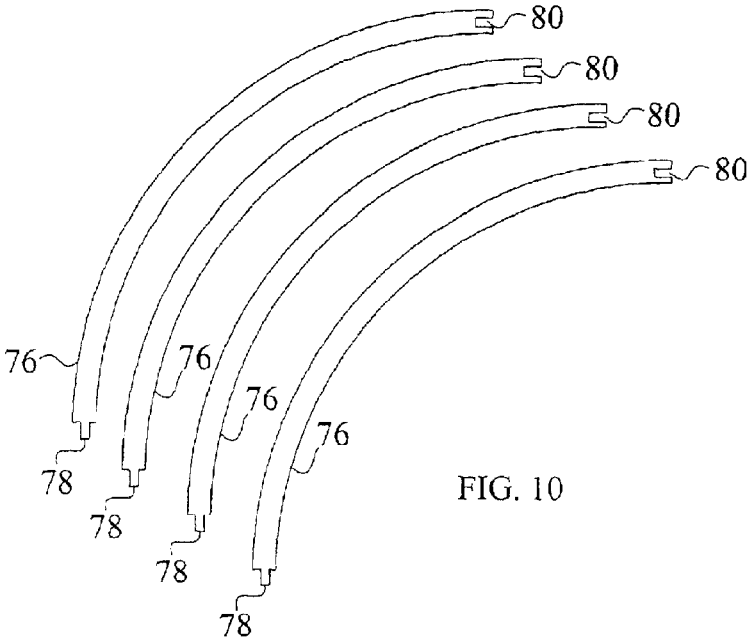
FIG. 10 is a plan view of separable sections of a ring.

FIG. 10 shows an embodiment of the outer ring 16, which comprises a plurality of separable sections 76. The illustrated embodiment provides attaching means, for example, tabs 78 and slots 80 can be provided for attaching sections to assemble a closed ring. Fasteners (not illustrated) for fixing the attachment of the sections can be selected from known and conventional fasteners such as bolts, screws, and cotter pins. The sections 76 are each illustrated as comprising one quarter of a circular ring for exemplary purpose, but may each comprise any portion of any ring of any shape within the scope of the invention.

The inner ring 14, the outer ring 16, the rail assembly 44, the carriage 46, and all of the components comprising the apparatus 10 of FIG. 5 and the embodiments of the invention illustrated in the figures and discussed above may each be constructed of materials known and conventionally used in the constructions of tools and tool assemblies. Steel, stainless steel, fiberglass, plastic, and composite materials may each or together be selected for use in the construction of the invention according to desirable material properties such as strength, durability, and weight. Handles or grips may be provided for convenient carrying and use of the invention.

Although the detailed descriptions above specify apparatuses and methods useful for constructing a graded floor around a drain within an enclosure such as a shower stall, it should be understood that the same are useful in shaping any fill material surface around a vertical minimum or low point for the collection and or drainage of liquid or flowing matter. The construction of a graded surface as described above can include, precede, or omit placement or construction of an actual drain assembly, drain aperture, or means to provide the exit of liquid or flowing matter. The apparatuses and methods disclosed herein are useful in the construction of showers, fountains, pools, and generally graded surfaces for any use with or without the placement of tiles or upper flooring material therein or thereon.

It will be apparent to those skilled in the art that various modifications and variations can be made in the present invention without departing from the scope or spirit of the invention. Other embodiments of the invention will be apparent to those skilled in the art as a result of consideration of the specification and practice of the invention disclosed herein. It is intended that the specification and examples be considered as exemplary only, with the true scope and spirit of the invention being indicated by the following claims.

What is claimed is:

1. An apparatus for shaping a substantially conical graded surface in a fill material around a drain, the apparatus comprising:

an inner ring and an outer ring, said inner ring and said outer ring each having a height and defining an enclosed area, wherein the height of said outer ring is greater than the height of said inner ring, and wherein the enclosed area of said outer ring is greater than the enclosed area of said inner ring;

a rail assembly connected at each of two ends to diametrically opposed portions of said outer ring, wherein said rail assembly is located above the enclosed area defined by said outer ring;

a carriage movably connected to said rail assembly, and pivotally connected to diametrically opposed portions of said inner ring below said rail assembly such that said inner ring may be adjustably moved along the direction of said rail assembly within a boundary defined above said outer ring.

2. The apparatus as claimed in claim 1, wherein at least one end of said rail assembly is vertically adjustable with respect to said outer ring.

3. The apparatus as claimed in claim 1, wherein said rail assembly is sloped relative to said enclosed area of said outer ring.

4. The apparatus as claimed in claim 1, further comprising a carriage-locking means for variably fixing the position of said carriage along said rail assembly.

5. The apparatus as claimed in claim 1, wherein at least one of said inner ring and said outer ring has a plurality of apertures defined therein.

6. The apparatus as claimed in claim 1, wherein at least one of said inner ring and said outer ring has an extended lip along a bottom edge.

7. The apparatus as claimed in claim 1, said outer ring comprising a plurality of separable sections.

8. The apparatus as claimed in claim 1, further comprising a first plurality of adjustable legs attached to said outer ring.

9. The apparatus as claimed in claim 5, further comprising a second plurality of adjustable legs attached to said inner ring.

10. The apparatus as claimed in claim 1, further comprising an elongate surfacing blade contacting the top edge of the said inner ring and the top edge of the said outer ring.

11. An apparatus for shaping a graded surface in a fill material around a vertical minimum, the apparatus comprising:

an inner ring and an outer ring, said inner ring and said outer ring each having a height and defining an enclosed area, wherein the height of said outer ring is greater than the height of said inner ring, and wherein the enclosed area of said outer ring is greater than the enclosed area of said inner ring;

a plurality of adjustable legs attached to said outer ring;

a rail assembly connected at each of two ends to diametrically opposed portions of said outer ring, wherein said rail assembly is located above the enclosed area defined by said outer ring, and wherein at least one end of said rail assembly is vertically adjustable with respect to said outer ring;

a carriage movably connected to said rail assembly, and pivotally connected to diametrically opposed portions of said inner ring below said rail assembly such that said inner ring may be adjustably moved along the direction of said rail assembly within a boundary defined above said outer ring.

12. An apparatus for shaping a graded surface in a fill material, the apparatus comprising:

a first ring having a first height and defining a first enclosed area;

a second ring adjustably positioned independently of said first ring within the first ring, said second ring having a second height and defining a second enclosed area, wherein the second height is less than the first height and the second enclosed area is less than the first enclosed area; and an elongate blade contacting the top edge of said first ring and contacting the top edge of said second ring so that said blade is sloped relative to the first enclosed area.

* * * * *